US007648079B2

(12) United States Patent
Suess

(10) Patent No.: US 7,648,079 B2
(45) Date of Patent: Jan. 19, 2010

(54) GROOVED RAIL

(75) Inventor: Joachim Suess, Dresden (DE)

(73) Assignee: Thyssenkrupp GFT Gleistechnik GmbH, Essen (DE)

( * ) Notice: Subject to any disclaimer, the term of this patent is extended or adjusted under 35 U.S.C. 154(b) by 271 days.

(21) Appl. No.: 11/667,523

(22) PCT Filed: Nov. 3, 2005

(86) PCT No.: PCT/DE2005/001961

§ 371 (c)(1),
(2), (4) Date: May 10, 2007

(87) PCT Pub. No.: WO2006/050693

PCT Pub. Date: May 18, 2006

(65) Prior Publication Data

US 2007/0278322 A1 Dec. 6, 2007

(30) Foreign Application Priority Data

Nov. 12, 2004 (DE) ..... 10 2004 054 794

(51) Int. Cl.
*E01B 5/00* (2006.01)

(52) U.S. Cl. ..... 238/128; 238/163; 238/127; 238/142

(58) Field of Classification Search ..... 238/3, 238/4, 5, 6, 7, 8, 9, 122, 127, 148, 128, 129, 238/136, 142
See application file for complete search history.

(56) References Cited

FOREIGN PATENT DOCUMENTS

| | | |
|---|---|---|
| DE | 70438 | 12/1890 |
| DE | 479 362 | 7/1929 |
| DE | 195 39 590 | 4/1997 |
| EP | 1 462 570 | 9/2004 |
| FR | 2 816 967 | 5/2002 |
| FR | 2854410 | * 11/2004 |
| RU | 1788116 | * 1/1993 |
| WO | WO-01/83889 | 11/2001 |

* cited by examiner

*Primary Examiner*—Mark T Le
(74) *Attorney, Agent, or Firm*—Jordan and Hamburg LLP

(57) ABSTRACT

Provided is a grooved rail for rail vehicles having flanged wheels, the grooved rail including a rail head provided with a running rail, a flange groove, and a counterrail, in addition to a rail web, a rail base, and lateral rail chambers extending between the rail head and the rail base. The running rail includes an asymmetrically-arranged vehicle-guiding flange, extending towards the flange groove, the asymmetrically-arranged flange formed in such a way that the width part of the rail base, on the side of the running rail, is larger than the width part on the side of the counterrail by a factor of at least 1.2. When the depth of the flange groove is >20 mm, the flange has a flange inclination of >78° with respect to an essentially horizontal axis of the rail web.

14 Claims, 1 Drawing Sheet

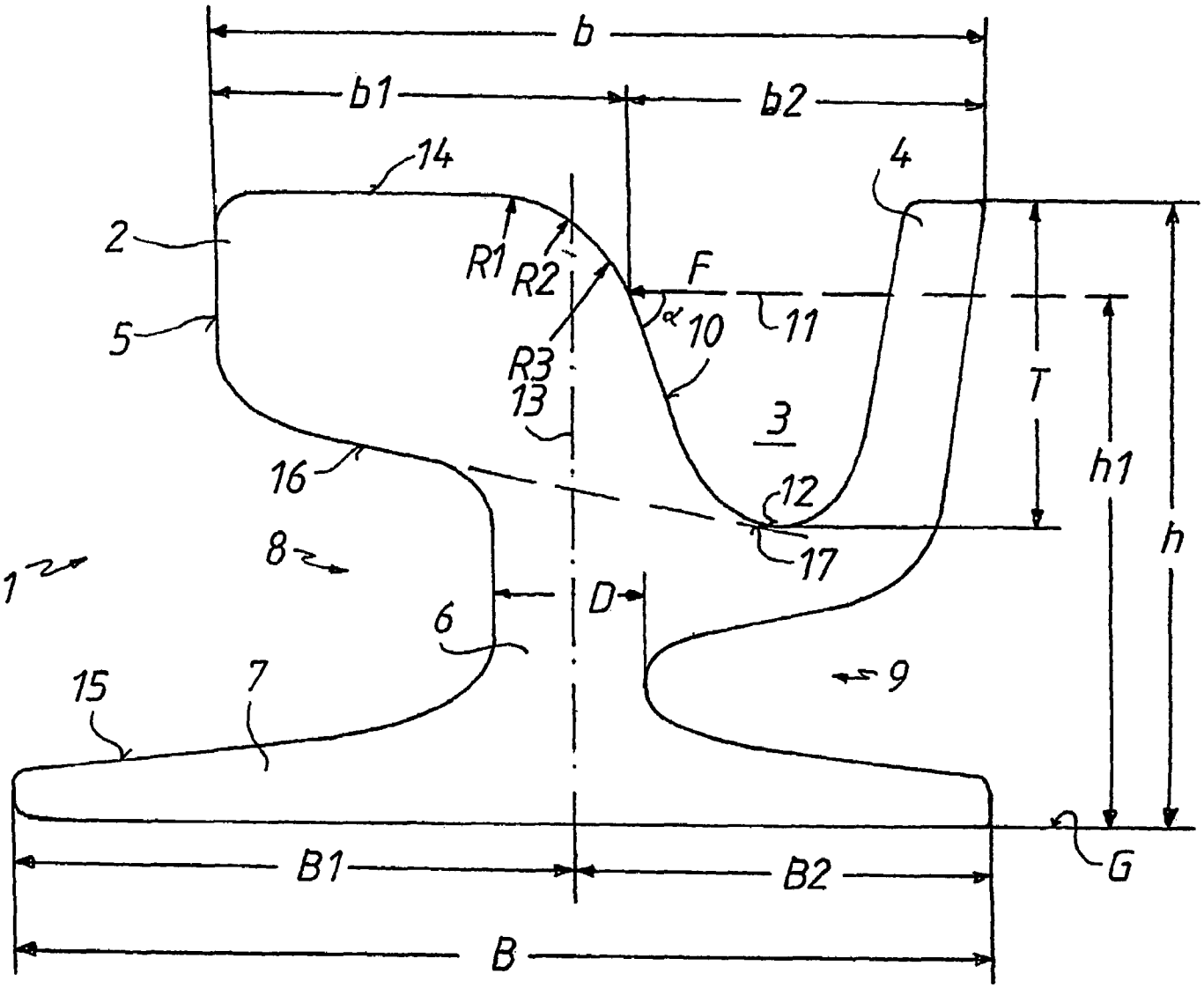
h
h1
T
G
b
b2
b1
4
11
3
12
17
9
F
α
10
R1
R2
R3
13
D
B2
B
B1
14
6
16
8
7
2
5
15
1

GROOVED RAIL

BACKGROUND OF THE INVENTION

The invention relates to a grooved rail for rail vehicles provided with flange wheels.

Grooved rails have already been known for many decades, wherein the constructional structure thereof has hardly changed over the time.

Herein reference is made to for example DE 70438 as well as DE 195 39 590.

Grooved rails according to the state of the art which are inertia rails, i.e. with web thicknesses of <50% of the rail head width, often have a cross section with a slim shape.

With regard to modifications of the rail vehicles that roll on the grooved rails, in particular the flange wheels thereof, such profiles can no more used efficiently, since there will be more wear due to stronger transverse forces, in particular in the region of the flange grooves respectively the flanges which are present there.

It is the object of the subject of invention to provide a grooved rail profile that meets the actual requirements with regard to substantially lesser roadway thicknesses, for example solid roadways, in particular of road constructions, that can be easily produced and that is also able to receive essentially horizontal transverse forces with a safe, in particular elastic, support on the soil or components that cooperate therewith.

SUMMARY OF THE INVENTION

This aim is achieved in that the flange has a flange inclination ($\alpha$) of <78°, preferably <75°, with respect to an essentially horizontal axis of the rail head when the depth of the flange groove (T) is >20 mm, i.e. in case of a deep groove, that the rail base comprising a pre-determinable total width is asymmetrically arranged with respect to the rail head with reference to the vertical central axis of the rail web, such that the width part of the rail base on the side of the vertical axis at which at least a major portion of the running rail is located, is at least 1.2, preferably at least 1.3, times larger than the width part on the side of the vertical axis where the counterrail is located and that the width of the running rail is from 55 to 65% of the total width of the rail head.

It is preferred that an essentially horizontally extending running surface of the running rail run into the flange via a plurality of decreasing transition radii that merge into each other.

The ratio of the total height of the grooved rail to the total width of the rail head preferably is from 1:1.2 to 1:1.4.

The ratio of the total height of the grooved rail to the total width of the rail base preferably is from 1:1.5 to 1:1.8.

The ratio of the total width of the rail head to the total width of the rail preferably is from 1:1.2 to 1:1.4.

The depth of the flange groove preferably is at least 50% of the total height of the grooved rail.

The ratio of the thickness of the rail web to the total width of the rail base preferably is from 1.4 to 1.9.

Preferably the flange of the running rail contiguous with the rail chamber on the side of the vertical axis where at least a major portion of the running rail is located is inclined in the direction of the rail base whereby an imaginary prolongation of the flange intersects the bottom of the flange groove.

In comparison to the state of the art, a profile can thus be provided that has a relatively small constructional height (≦100 mm). Due to the indicated ratios that are defined in the sub-claims, a grooved rail profile is defined such that an enlarged running rail is obtained in combination with a reduced inclination angle of the flange with respect to the state of the art which causes less wear, on the one hand, and a better resistance to transverse forces, on the other hand, in that the proportion of the width parts of the rail base in connection with the enlarged web thickness and the reduced lever arm of the application of force cause the horizontal excursion of the rail head to be reduced towards the base point.

Furthermore, the modified flange inclination angle still has advantages with respect to the tracking in comparison to the state of the art, in particular for curved running, whereby the travel comfort is improved.

The subject of invention is represented in the drawing by means of an exemplary embodiment and is described as follows.

BRIEF DESCRIPTION OF THE DRAWING

A schematic cross sectional view of a grooved rail according to the invention is shown in the drawing.

DETAILED DESCRIPTION OF THE INVENTION

The only exemplary embodiment shows a schematic diagram, not necessarily in correct scale, of the profile of a grooved rail 1 which, in this example, shall be installed on a solid roadway made of concrete. The grooved rail 1 comprises a rail head 5 provided with a running rail 2, a flange groove 3 as well as a counterrail 4, in addition to a rail web 6 and a rail base 7. Lateral rail chambers 8, 9 that have a different height extend between the rail head 5 and the rail base 7. The running rail 2 comprises a vehicle guiding flange 10 that extends towards the flange groove 3. With respect to an imagined horizontal axis 11 the flange 10 extends in the direction of the groove bottom 12 of the flange groove 3 with an inclination angle $\alpha$ that shall be 76° in this example. The gradient of the flange 10 is thus approximately 1:4.0. The rail head 5 has a total width b, wherein the portion of the running rail b1 is formed with respect to the remaining portion b2, such that the width b1 of the running rail 2 corresponds to the rolling width of a usual tire of 95 mm and is 57% of the total width b of the rail head 5 in this example.

The rail base 7 comprising a pre-determinable total width B is asymmetrically arranged with respect to the rail head 5, such that the width part B1 on the side of the running rail is larger by the factor 1.4 than the width part B2 on the side of the counterrail in this example. Herein, reference is made to the vertical central axis 13 of the rail web 6 comprising a pre-determinable thickness D. The running surface 14 of the running rail 2 extends over several radii R1, R2, R3 into the vehicle guiding flange 10, wherein the radius R1 becomes continuously smaller in the direction of R3 via R2 that verge into each other. The total height of the grooved rail 1 is indicated with h. Herein the base is the area G of the rail base. The flange groove 3 which is realised as deep groove has a total depth T. In this example the ratio between the total height h of the grooved rail 1 and the total width b of the rail head shall be 1:1.25. The ratio between the total height h of the grooved rail 1 and the total width B of the rail base 7 shall be 1:1.65 in this example. The ratio between the total width b of the rail head 5 and the total width B of the rail base 7 shall be approximately 1:1.3 in this example.

The ratio between the groove depth T and the total height h of the grooved rail 1 is minimum 1:2. The ratio between the thickness D of the rail web 6 and the total width B of the rail base 7 shall be approximately 1:7 in this example.

The rail chamber 8 on the side of the running rail is defined by a flange 15 on the side of the rail base and a flange 16 on the side of the running rail, which flanges suitably extend towards each other.

The imagined prolongation 17 of the flange 16 on the side of the running rail intersects the groove bottom of the flange groove 3 in this example.

Thanks to the profile of the grooved rail 1 that is defined in the claims and that has a small constructional height h and an optimized width B of the rail base 7 in connection with the indicated flange angle $\alpha$ with an approximately horizontal application of force F by the flange wheel of a no further represented rail vehicle it is possible to obtain a good support of the grooved rail 1 on a hard or elastic soil of a solid roadway without tilting moments becoming active. The height h1 of the horizontal application of force F on the flange 10 of the running rail 2 is comprised between 0.8 and 0.9 h of the grooved rail 1 with respect to the base, i.e., bottom, plane G of the rail base. The width part B1 on the side of the running rail shall satisfy the following equation in this example:

$$B1=B2+D.$$

The width b1 of the running rail 2 shall approximately correspond to the width part B2 of the rail base 7 on the side of the counterrail, wherein the width part B2 on the side of the counterrail shall be < the total height h of the grooved rail 1. Finally, the width part B1 on the side of the running rail shall be ≦ than the height h1.

The invention claimed is:

1. A grooved rail for rail vehicles provided with flange wheels, said grooved rail comprising a rail head provided with a running rail, a flange groove, a counterrail, a rail web, a rail base and lateral rail chambers extending between the rail head and the rail base, wherein the running rail comprises a vehicle guiding flange extending towards the flange groove, said flange having a flange inclination of <78° with respect to an essentially horizontal axis of the rail head when depth of the flange groove is >20 mm, and total width of the rail base is asymmetrically arranged with respect to the rail head with reference to a vertical central axis of the rail web whereby the total width of the rail base consists of a first part on a first side of the vertical axis including at least a major portion of the running rail and a second portion on a second side of the vertical axis including the counterrail, the first portion being larger at least by a factor 1.2 than the second portion and width of the running rail being from 55 to 65% of total width of the rail head and further wherein the ratio of total height of the grooved rail to the total width of the rail head is from 1:1.2 to 1:1.4.

2. A grooved rail according to claim 1, wherein an essentially horizontally extending running surface of the running rail runs into the flange via a plurality of decreasing transition radii that merge into each other.

3. A grooved rail according to claim 1, wherein ratio of total height of the grooved rail to the total width of the rail base is from 1:1.5 to 1:1.8.

4. A grooved rail according to claim 1, wherein ratio of total width of the rail head to the total width of the rail base is from 1:1.2 to 1:1.4.

5. A grooved rail according to claim 1, wherein the depth of the flange groove is at least 50% of total height of the grooved rail.

6. A grooved rail according to claim 1, wherein ratio of thickness of the rail web to the total width of the rail base is from 1:4 to 1:9.

7. A grooved rail according to claim 1, wherein the inclination angle is <75°.

8. A grooved rail according to claim 1, wherein the first portion is larger than the second portion by a factor at least 1.3.

9. A grooved rail according to claim 1, wherein the flange of the running rail contiguous with the rail chamber on the first side of the vertical axis is inclined in a direction of the rail base whereby an imaginary prolongation of said flange intersects a bottom of the flange groove.

10. A grooved rail according to claim 1, wherein $$B1=B2+D,$$

and B1 is the first portion of the total width of the rail base,

B2 is the second portion of the total width of the rail base and

D is the thickness of the web.

11. A grooved rail according to claim 1, wherein width of the running rail essentially corresponds to the second portion of the total width of the rail base and the second portion of the total width of the rail base is less than total height of the grooved rail.

12. A grooved rail according to claim 1, wherein the first portion of the total width of the rail base is equal to or greater than height of a plane of application of force on the running rail with respect to a bottom plane of the rail base.

13. A grooved rail for flange-wheeled rail vehicles, the grooved rail comprising a rail head provided with a running rail whose width is 55 to 65% of the total width of the rail head, a flange groove, a counterrail, a rail web, a rail base and lateral rail chambers extending between the rail head and the rail base, wherein the running rail comprises a vehicle guiding flange extending towards the flange groove, the guiding flange having a flange inclination of <78° with respect to an essentially horizontal axis of the rail head when depth of the flange groove is >20 mm, total width of the rail base being asymmetrically arranged with reference to a vertical central axis of the rail web, the total width of the rail base consisting of a first part on a first side of the vertical axis and a second portion on a second side of the vertical axis including the counterrail, the first portion being larger than the second portion by a factor of at least 1.2; and further wherein the ratio of total height of the grooved rail to the total width of the rail head is from 1:1.2 to 1:1.4, the total height of the grooved rail to the total width of the rail base is from 1:1.5 to 1:1.8, the ratio of the total width of the rail head to the total width of the rail base is from 1:1.2 to 1:1.4, and the ratio of the thickness of the rail web to the total width of the rail base is from 1:4 to 1:9.

14. The grooved rail according to claim 13, wherein the depth of the flange groove is at least 50% of total height of the grooved rail.

* * * * *